US009454164B2

(12) United States Patent
Bhattad

(10) Patent No.: US 9,454,164 B2
(45) Date of Patent: Sep. 27, 2016

(54) METHOD AND APPARATUS FOR LIMITING STARTUP INRUSH CURRENT FOR LOW DROPOUT REGULATOR

(71) Applicant: Dialog Semiconductor GmbH, Kirchheim/Teck-Nabern (DE)

(72) Inventor: Ambreesh Bhattad, Swindon (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 51 days.

(21) Appl. No.: 14/020,979

(22) Filed: Sep. 9, 2013

(65) Prior Publication Data

US 2015/0061622 A1 Mar. 5, 2015

(30) Foreign Application Priority Data

Sep. 5, 2013 (EP) ..... 13368027

(51) Int. Cl.

| | |
|---|---|
| ***G05F 1/565*** | (2006.01) |
| ***G05F 1/56*** | (2006.01) |
| ***G05F 1/573*** | (2006.01) |

(52) U.S. Cl.

CPC ..... *G05F 1/56* (2013.01); *G05F 1/573* (2013.01)

(58) Field of Classification Search

CPC ..... G05F 1/613; G05F 1/575; G05F 1/56

USPC ..... 323/273, 280, 303, 226, 274, 275, 281, 323/269, 270, 276, 279

See application file for complete search history.

(56) References Cited

U.S. PATENT DOCUMENTS

| | | | | |
|---|---|---|---|---|
| 4,704,572 | A | 11/1987 | Melbert | |
| 6,201,375 | B1 * | 3/2001 | Larson | G05F 1/573 323/277 |
| 7,402,987 | B2 | 7/2008 | Lopata | |
| 7,459,891 | B2 | 12/2008 | Al-Shyoukh et al. | |
| 2001/0030530 | A1 * | 10/2001 | Marty | G05F 1/565 323/280 |
| 2001/0050546 | A1 | 12/2001 | Marty | |
| 2006/0145673 | A1 | 7/2006 | Fogg et al. | |
| 2009/0201618 | A1 | 8/2009 | Hasegawa et al. | |
| 2011/0248688 | A1 * | 10/2011 | Iacob | G05F 1/56 323/234 |
| 2012/0200283 | A1 * | 8/2012 | Socheat | G05F 1/575 323/316 |
| 2014/0210430 | A1 * | 7/2014 | Bhattad | G05F 3/02 323/233 |
| 2015/0035505 | A1 * | 2/2015 | Peluso | G05F 1/575 323/273 |

FOREIGN PATENT DOCUMENTS

| | | |
|---|---|---|
| EP | 2 579 120 | 4/2013 |
| GB | 2 381 882 | 5/2003 |

OTHER PUBLICATIONS

European Search Report 13368027.2-1807 Mailed: Feb. 6, 2014, Dialog Semiconductor GmbH.

* cited by examiner

*Primary Examiner* — Adolf Berhane
*Assistant Examiner* — Alex Torres-Rivera
(74) *Attorney, Agent, or Firm* — Saile Ackerman LLC; Stephen B. Ackerman

(57) ABSTRACT

A low dropout (LDO) regulator with a limited startup inrush current is disclosed. The LDO includes a power source, error amplifier, pass transistor, feedback network, and a current limit control whose input is electrically connected to the pass transistor and the electrical output of the error amplifier and whose output limits current during startup. The LDO can include a current control limit comparator including a power source, and output of the pass transistor. The LDO can also include a bypass mode current control limit comparator having a first input voltage of the error amplifier, and a second input voltage from the error amplifier.

18 Claims, 11 Drawing Sheets

METHOD AND APPARATUS FOR LIMITING STARTUP INRUSH CURRENT FOR LOW DROPOUT REGULATOR

BACKGROUND

1. Field

The disclosure relates generally to a low dropout regulator (LDO) circuits and methods and, more particularly, to a low dropout circuit device having improved limitation of startup inrush current and a method thereof.

2. Description of the Related Art

Low dropout (LDO) regulators are a type of voltage regulators used in conjunction with semiconductor devices, integrated circuit (IC), battery chargers, and other applications. Low dropout regulators (LDO) can be used in digital, analog, and power applications to deliver a regulated supply voltage.

An example of a prior art, a low dropout (LDO) regulator is illustrated in FIG. 1. An LDO regulator consists of an error amplifier 1, pass transistor 2, and a feedback network 3. The LDO regulator can be defined using bipolar transistors, or metal oxide semiconductor field effect transistors (MOSFETs). For a MOSFET-based implementation, the pass transistor 2 is typically a p-channel MOSFET device. The pass transistor 2 has a MOSFET source connected to voltage $V_{DD}$, and whose MOSFET drain connected to output voltage, $V_{OUT}$, and whose MOSFET gate is connected to the output of error amplifier 1. The error amplifier 1 has a negative input defined as voltage reference input, $V_{REF}$, and a positive input signal feedback voltage, $V_{FB}$. The feedback network 3 is connected between the p-channel MOSFET output voltage $V_{OUT}$, and ground reference $V_{SS}$. The feedback network 3 can consist of a resistor divider network whose output is the feedback voltage, $V_{FB}$.

As illustrated in FIG. 2, the start-up current for a low dropout (LDO) regulator is shown in an LDO mode of operation. In the LDO mode of operation, there is a inrush current that exceeds the operational mode of a low dropout (LDO) regulator. This large inrush current is not desirable for low dropout (LDO) applications.

As illustrated in FIG. 3, the start-up current for a low dropout (LDO) regulator is shown in a Bypass mode of operation. In the Bypass mode of operation, there is an even larger inrush current that exceeds the operational mode of a low dropout (LDO) regulator. This large inrush current is not desirable for low dropout (LDO) applications.

In low dropout (LDO) regulators, the startup overshoot control has been discussed by modification of the feedback network through an output voltage based feedback loop. As discussed in published U.S. Pat. No. 7,402,987 to Lopata, a resistor element in the feedback loop is replaced by a variable resistor.

In low dropout (LDO) regulators, the startup overshoot control has been discussed by introduction of a soft-start. As discussed in published U.S. Pat. No. 7,459,891 to Al-Shyoukh et al., a control unit provides a control signal to a controllable resistor element to decrease incrementally in value.

In low dropout (LDO) regulators, the startup overshoot control has been discussed by buffering an associated supply input decoupling capacitor. As discussed in published U.S. Pat. Application 2006/0145673 to Fogg et al., a selectively configured current path is chosen that has a high impedance for startup charging of the decoupling capacitor, and a low impedance for normal operations of the circuit.

In these prior art embodiments, the solution to improve the response of the low dropout (LDO) regulator utilized modification of the resistors contained within the feedback or changing the charging of a capacitor.

SUMMARY

It is desirable to provide a solution to address the inrush current in low dropout (LDO) mode of operation.

It is desirable to provide a solution to address the inrush current in low dropout in Regulation or Bypass mode of operation.

A principal object of the present disclosure is to provide a circuit device to limit the inrush current at startup in LDO mode of operation.

A principal object of the present disclosure is to provide a circuit device to limit the inrush current if the low dropout (LDO) can be started in regulation or bypass mode of operations.

Another further object of the present disclosure is to provide a method to vary gain in an input circuit device.

In accordance with the objects of this disclosure, a low dropout (LDO) device with improved network to limit, minimize and mitigate startup inrush current in LDO mode, and Bypass mode of operations.

Also in accordance with the objects of this disclosure, a low dropout (LDO) device that avoid brownout condition for the system if the system supply was close to lower limit of operating condition.

The above and other objects are achieved by a low dropout device with limiting startup inrush current, the device comprising a power source, an error amplifier, a pass transistor coupled to an error amplifier and supplied from a power source, a feedback network electrically connected to a pass transistor and whose output is electrically coupled to the input of said error amplifier, and a current limit control network whose input is electrically connected to a pass transistor and the electrical output of an error amplifier and whose output is providing a current limit.

The above and other objects are achieved by using a startup control apparatus providing a current limit control device comprising, a power source, a ground source, a current control signal input, a current startup signal input, a first current source between a power source and a current control signal input, a second current source between a ground source and a current control signal input and a switch whose input is a current startup signal input.

The above and other objects are achieved with a method of limiting startup inrush current in a low dropout circuit comprising of providing a power source, providing an output signal, providing an error amplifier, providing a pass transistor between said power source and said output signal wherein a pass transistor coupled to said error amplifier and supplied from a power source, providing a feedback network electrically connected to said pass transistor and whose output is electrically coupled to the input of said error amplifier, and providing a current limit control network whose input is electrically connected to said pass transistor and the electrical output of said error amplifier and whose output is providing a current limit.

As such, a novel low dropout (LDO) device with a limited startup inrush current in LDO mode, and BYPASS mode is desired. Other advantages will be recognized by those of ordinary skill in the art.

BRIEF DESCRIPTION OF THE DRAWINGS

The present disclosure and the corresponding advantages and features provided thereby will be best understood and appreciated upon review of the following detailed description of the disclosure, taken in conjunction with the following drawings, where like numerals represent like elements, in which.

DETAILED DESCRIPTION

Figure 1:
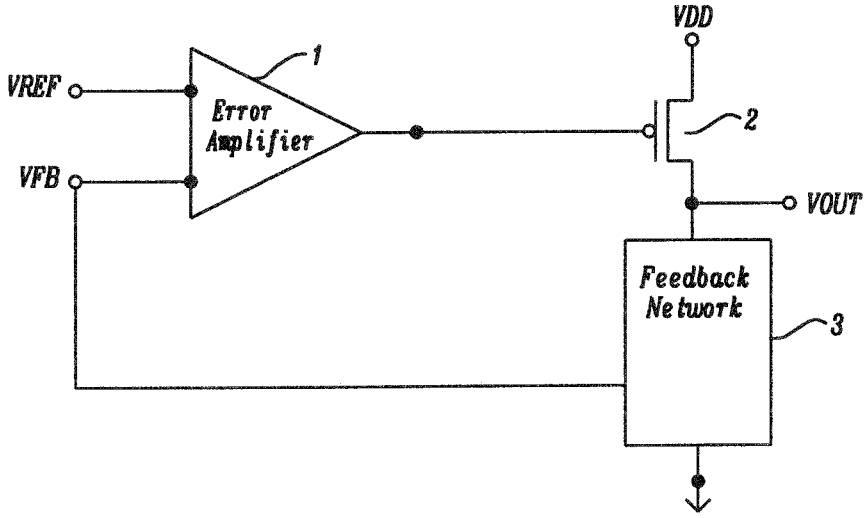
FIG. 1 Prior Art
FIG. 1 is a circuit schematic diagram illustrating a prior art embodiment of a low dropout (LDO) regulator.

FIG. 1 is a circuit schematic diagram illustrating a prior art embodiment of a low dropout (LDO) regulator in accordance with a prior art embodiment. An LDO regulator consists of an error amplifier 1, pass transistor 2, and a feedback network 3.

The LDO regulator can be defined using bipolar transistors, or metal oxide semiconductor field effect transistors (MOSFETs). For a MOSFET-based implementation, the pass transistor 2 is typically a p-channel MOSFET device. The pass transistor 2 has a MOSFET source connected to voltage $V_{DD}$, and whose MOSFET drain connected to output voltage, $V_{OUT}$, and whose MOSFET gate is connected to the output of error amplifier 1. The error amplifier 1 has a negative input defined as voltage reference input, $V_{REF}$, and a positive input signal feedback voltage, $V_{FB}$. The feedback network 3 is connected between the p-channel MOSFET output voltage $V_{OUT}$, and ground reference $V_{SS}$. The feedback network 3 can consist of a resistor divider network whose output is the feedback voltage, $V_{FB}$.

Figure 2:
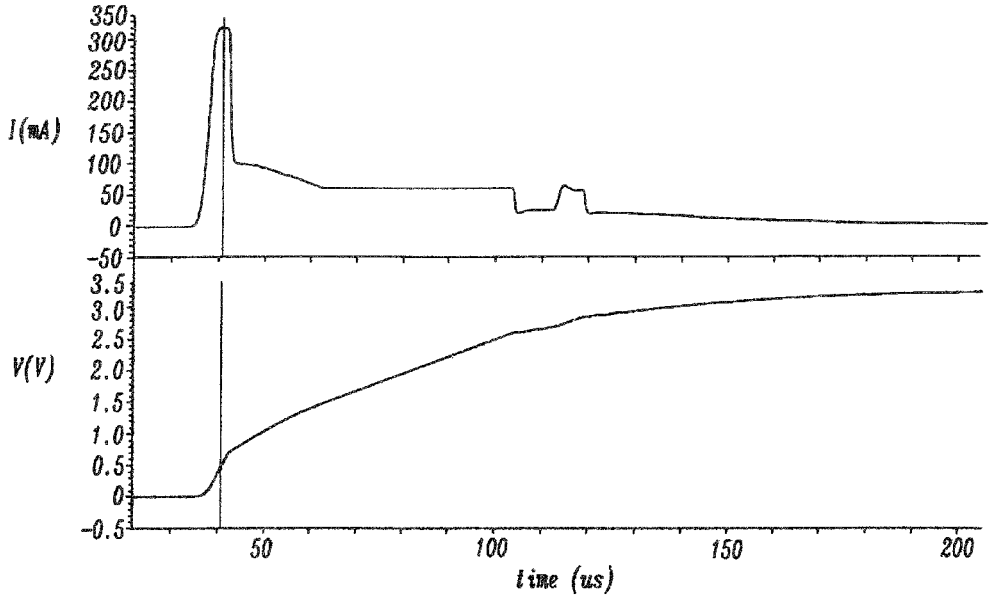
FIG. 2 Prior Art
FIG. 2 is a plot highlighting the startup current and voltage as a function of time for a 150 mA low dropout (LDO) in LDO mode of operation.

FIG. 2 is a plot highlighting the startup current and voltage as a function of time for a 150 mA low dropout (LDO) in LDO mode of operation. As illustrated in FIG. 2, the start-up current for a low dropout (LDO) regulator is shown in an LDO mode of operation. In the LDO mode of operation, there is a inrush current that exceeds the operational mode of a low dropout (LDO) regulator. A current spike of magnitude 318 mA is present as a result of the inrush current. The current settles to a lower magnitude below 150 mA by 50 micro-seconds. In this application, the inrush operational current is significantly lower than this inrush current magnitude. This large inrush current is not desirable for low dropout (LDO) applications.

Figure 3:
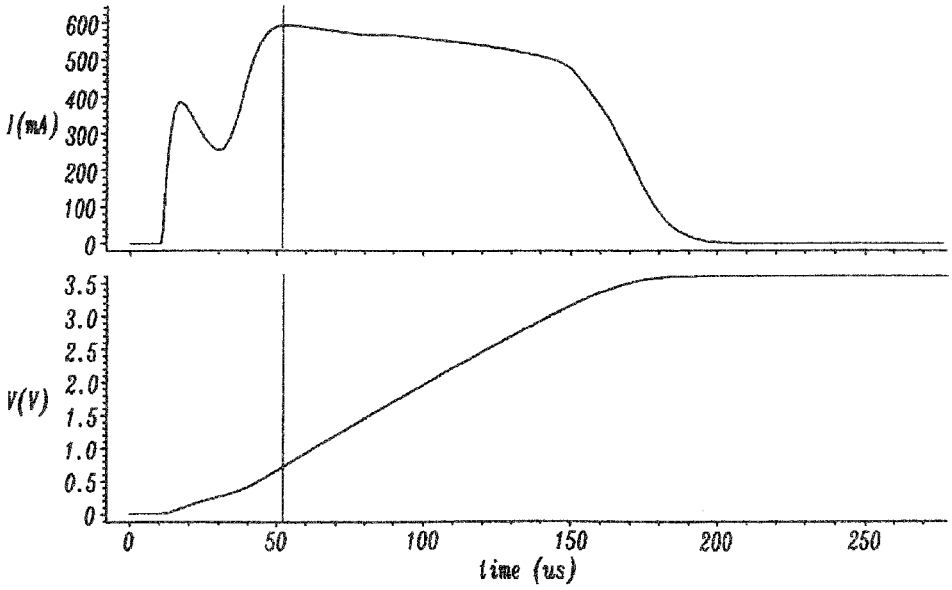
FIG. 3 Prior Art
FIG. 3 is a plot highlighting the startup current and voltage as a function of time for a 150 mA low dropout (LDO) in Bypass mode of operation.

FIG. 3 is a plot highlighting the startup current and voltage as a function of time for a 150 mA low dropout (LDO) in Bypass mode of operation. A first current spike prior to 5 microseconds is evident in the current characteristic. This is followed by a wide current plateau of greater than 500 mA, which extends to 15 microseconds. As the current limit in bypass mode is larger than the current limit in LDO mode, a larger inrush current is evident if the same LDO was used in a bypass mode of operation.

Figure 4:
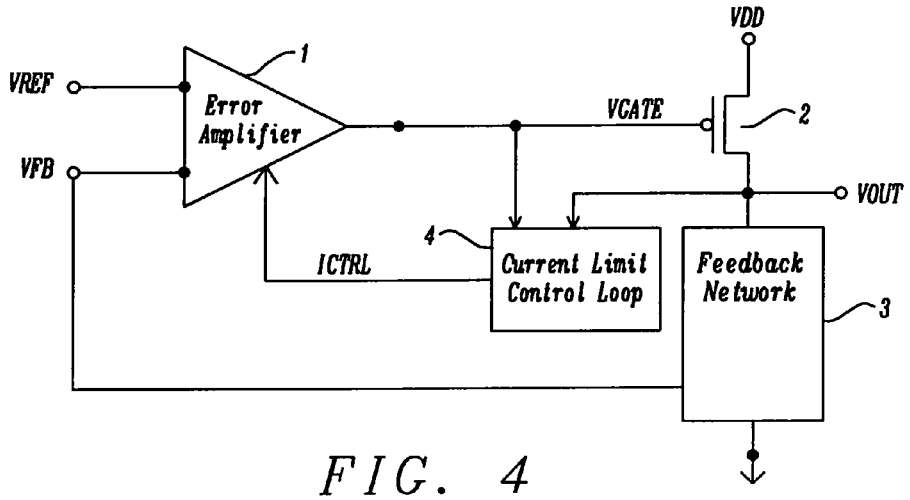
FIG. 4 a circuit schematic diagram illustrating a low dropout (LDO) regulator with current limit control loop in accordance with one embodiment of the disclosure.

In the preferred embodiment, FIG. 4 a circuit schematic diagram illustrating a low dropout (LDO) regulator with current limit control loop in accordance with one embodiment of the disclosure. An LDO regulator consists of an error amplifier 1, pass transistor 2, and a feedback network 3, and a current limit control loop 4. The pass transistor 2 is a p-channel metal oxide semiconductor field effect transistor (MOSFET).

The pass transistor 2 has a MOSFET source connected to voltage $V_{DD}$, and whose p-channel MOSFET drain connected to output voltage, $V_{OUT}$, and whose MOSFET gate is connected to the output of error amplifier 1. The error amplifier 1 has a negative input defined as voltage reference input, $V_{REF}$, and a second positive input signal feedback voltage, $V_{FB}$. The feedback network 3 is connected between the p-channel MOSFET output voltage $V_{OUT}$, and ground reference $V_{SS}$. The feedback network 3 can consist of a resistor divider network whose output is the feedback voltage, $V_{FB}$. The output of the error amplifier 1 is connected to a first input to the current limit control loop 4. The output voltage, VOUT, provides a second input to the current limit control loop 4. The current limit current loop uses the gate voltage, VGATE, and the output voltage, VOUT, signals to sense the current flowing through the p-channel MOSFET pass transistor 2. The output of the current limit control loop is coupled to the error amplifier 1. The output of the current limit control loop couples a current ICTRL to control the voltage at the p-channel MOSFET gate 2, hence limiting the current flow through the p-channel MOSFET 2.

Figure 5:
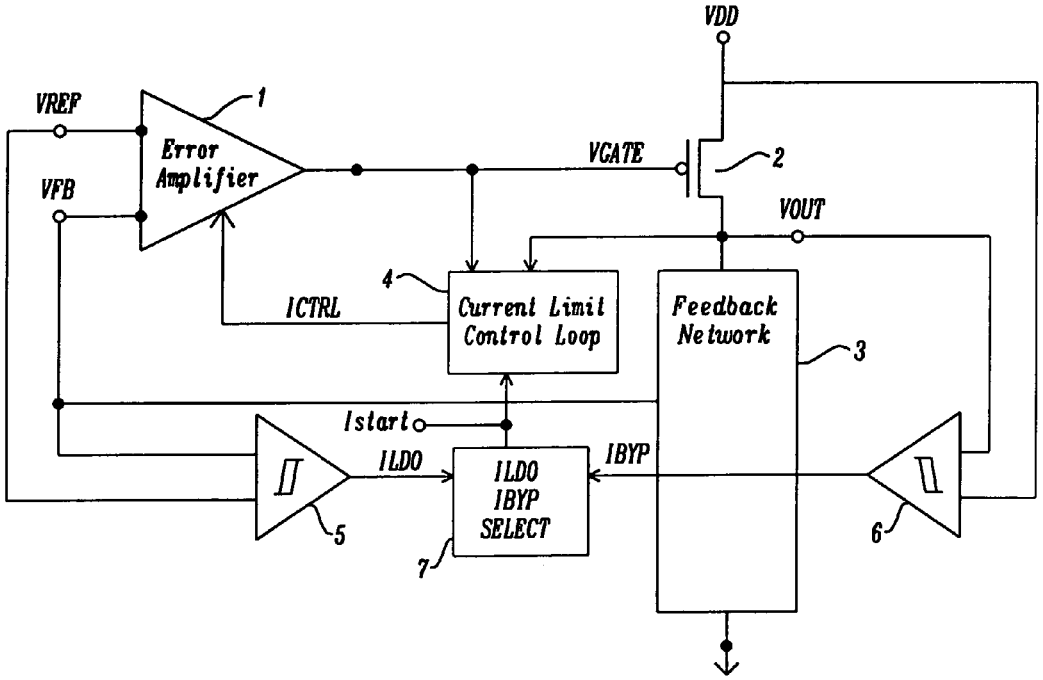
FIG. 5 a circuit schematic diagram illustrating a low dropout (LDO) regulator with current limit control loop and comparators in accordance with a second embodiment of the disclosure.

FIG. 5 a circuit schematic diagram illustrating a low dropout (LDO) regulator with current limit control loop and comparators in accordance with a second embodiment of the disclosure. An LDO regulator consists of an error amplifier 1, pass transistor 2, and a feedback network 3, and a current limit control loop 4, a VREF/VFB LDO mode comparator 5, a VOUT/VDD Bypass mode comparator 6, and a ILDO/

IBYP select control 7. The pass transistor 2 is a p-channel metal oxide semiconductor field effect transistor (MOSFET). The pass transistor 2 has a MOSFET source connected to voltage $V_{DD}$, and whose p-channel MOSFET drain connected to output voltage, $V_{OUT}$, and whose MOSFET gate is connected to the output of error amplifier 1. The error amplifier 1 has a negative input defined as voltage reference input, $V_{REF}$, and a second positive input signal feedback voltage, $V_{FB}$. The feedback network 3 is connected between the p-channel MOSFET output voltage $V_{OUT}$, and ground reference $V_{SS}$. The feedback network 3 can consist of a resistor divider network whose output is the feedback voltage, $V_{FB}$. The output of the error amplifier 1 is connected to a first input to the current limit control loop 4. The output voltage, VOUT, provides a second input to the current limit control loop 4. The current limit current loop uses the gate voltage, VGATE, and the output voltage, VOUT, signals to sense the current flowing through the p-channel MOSFET pass transistor 2. The output of the current limit control loop is coupled to the error amplifier 1. The output of the current limit control loop couples a current ICTRL to control the voltage at the p-channel MOSFET gate 2, hence limiting the current flow through the p-channel MOSFET 2. For the LDO mode comparator, a comparator 5, receives a first voltage reference input signal, VREF, and a second input signal, VFB. The output of the comparator 5 is the LDO current signal ILDO. The comparator compares the signal VFB with signal VREF and generates the signal ILDO. Once the signal VFB magnitude is near the signal VREF magnitude, the signal ILDO is asserted. The assertion of the signal ILDO is used to restore the normal current limit for LDO in regulation mode of operation.

For the Bypass mode comparator, a comparator 6, receives a first voltage reference input signal, VOUT, and a second input signal, VDD. The output of the comparator 6 is the bypass current signal IBYP. The comparator compares the signal VOUT with signal VDD and generates the signal IBYP. Once the signal VOUT magnitude is near the signal VDD magnitude, the signal IBYP is asserted. The assertion of the signal IBYP is used to restore the normal current limit for LDO in bypass mode of operation. The output signal ILDO, and the output signal IBYP serve as input signals for the ILDO/IBYP select network 7. This network is coupled to the current limit control loop 4.

Figure 6:
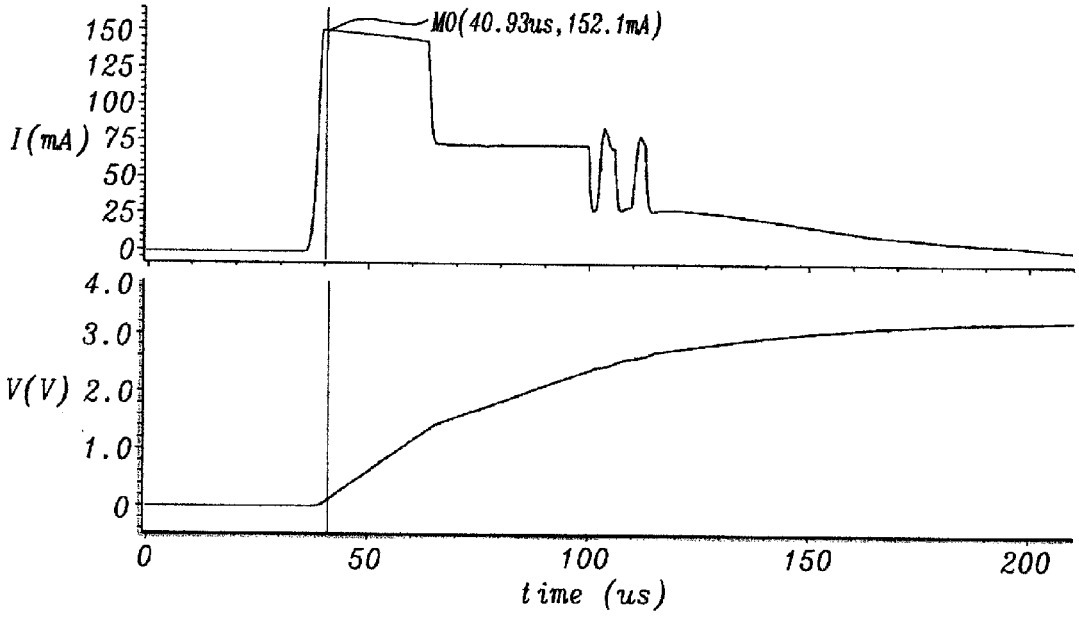
FIG. 6 is a plot highlighting the startup current and voltage as a function of time for a 150 mA low dropout (LDO) at startup in regulation mode of operation.

FIG. 6 is a plot highlighting the startup current and voltage as a function of time for a 150 mA low dropout (LDO) at startup in regulation mode of operation. In the figure, FIG. 6, the startup inrush current is limited to 150 mA at startup of the LDO in regulation mode. As discussed in FIG. 5, for the LDO mode comparator, a comparator 5, receives a first voltage reference input signal, VREF, and a second input signal, VFB. The output of the comparator 5 is the LDO current signal ILDO. The comparator compares the signal VFB with signal VREF and generates the signal ILDO. Once the magnitude of the signal VFB is near the magnitude of the signal VREF, the signal ILDO is asserted. The assertion of the signal ILDO is used to restore the normal current limit for LDO in regulation mode of operation.

Figure 7:
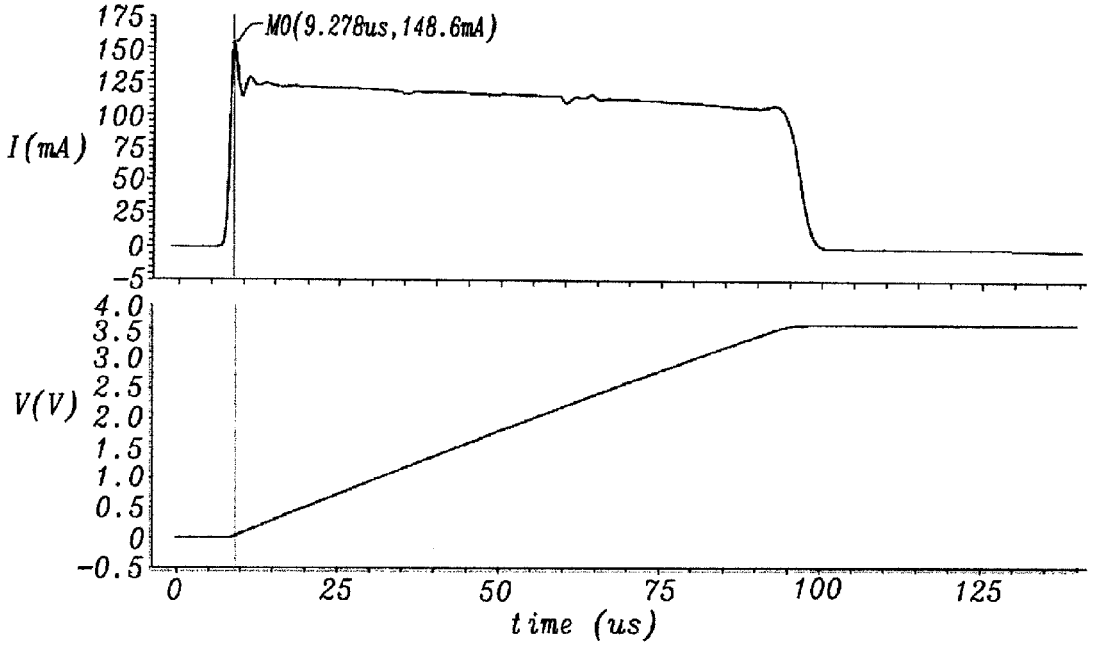
FIG. 7 is a plot highlighting the startup current and voltage as a function of time for a 150 mA low dropout (LDO) at startup in bypass mode of operation.

FIG. 7 is a plot highlighting the startup current and voltage as a function of time for a 150 mA low dropout (LDO) at startup in bypass mode of operation. The figure shows the limitation of the inrush current when starting the LDO in a bypass mode of operation. The current magnitude remains below the 150 mA current level through the startup cycle. As discussed in FIG. 5. for the bypass mode comparator, a comparator 6, receives a first voltage reference input signal, VOUT, and a second input signal, VDD. The output of the comparator 6 is the bypass current signal IBYP. The comparator compares the signal VOUT with signal VDD and generates the signal IBYP. Once the signal VOUT magnitude is near the signal VDD magnitude, the signal IBYP is asserted. The assertion of the signal IBYP is used to restore the normal current limit for LDO in bypass mode of operation.

Figure 8:
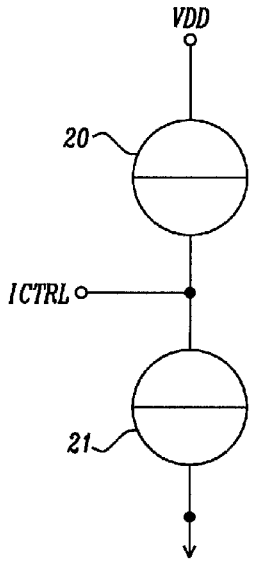
FIG. 8 is a circuit schematic diagram for the current limit control.

FIG. 8 is a circuit schematic diagram for the current limit control. Current control 20 is connected between the VDD signal and the current control, I CTRL. Current control 21 is connected between the VSS signal (e.g. ground) and the current control, I CTRL. Current control 20 is the sensed current, and current control 21 is the reference current. When current sense control 20 is less than current reference control 21, signal I CTRL is pulled to ground potential; in this state, the loop is "off". When current sense control 20 is of the same magnitude of current reference control 21, signal I CTRL which is coupled to error amplifier 1 of FIG. 4; this regulates the output of the error amplifier connected to the gate of the p-channel MOSFET pass transistor 2. In this state, the current control 20 is the same magnitude as current control 21.

Figure 9A:
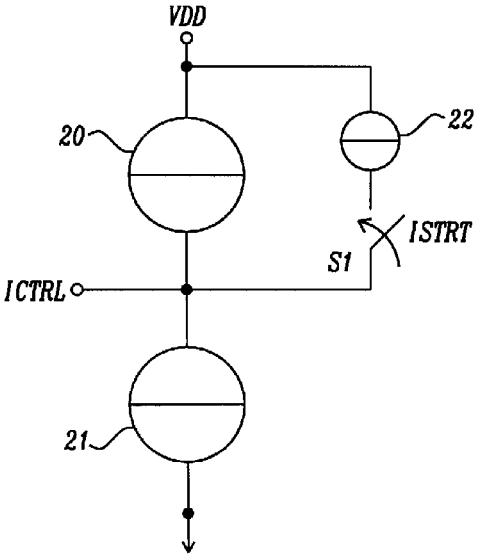
FIG. 9A is a second circuit schematic diagram for the current limit control with switch.
Figure 9B:
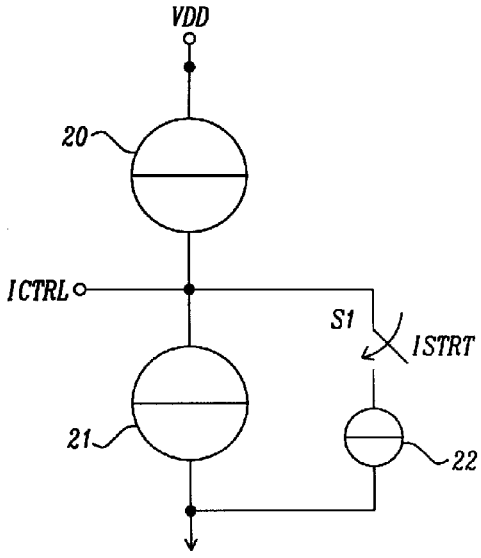
FIG. 9B is a third circuit schematic diagram for the current limit control with switch.

FIG. 9A is a second circuit schematic diagram for the current limit control with the addition of a switch. In FIG. 9, an additional current control 22 is placed in series with a switch S1. In this embodiment, the current limit at startup is modified by a first methodology of increasing current control 20, and then restored to a normal state, or a second methodology of decreasing current control 21 at startup, and then restored to a normal state. FIG. 9A shows a first case of current control 22 and switch S1 coupled between VDD and ICNTRL. and a FIG. 9B is a third case of current control 22 and switch S1 couple between I-CTRL and ground. As illustrated in FIG. 9A, the sensed current is increased at startup; Switch S1 is closed at startup and when signal ISTRT is asserted, S1 is opened to restore the normal current limit. As illustrated in FIG. 9B, the referenced current is decreased at startup; Switch S1 is open at startup and when signal ISTRT is asserted, S1 is closed to restore the normal current limit.

Figure 10:
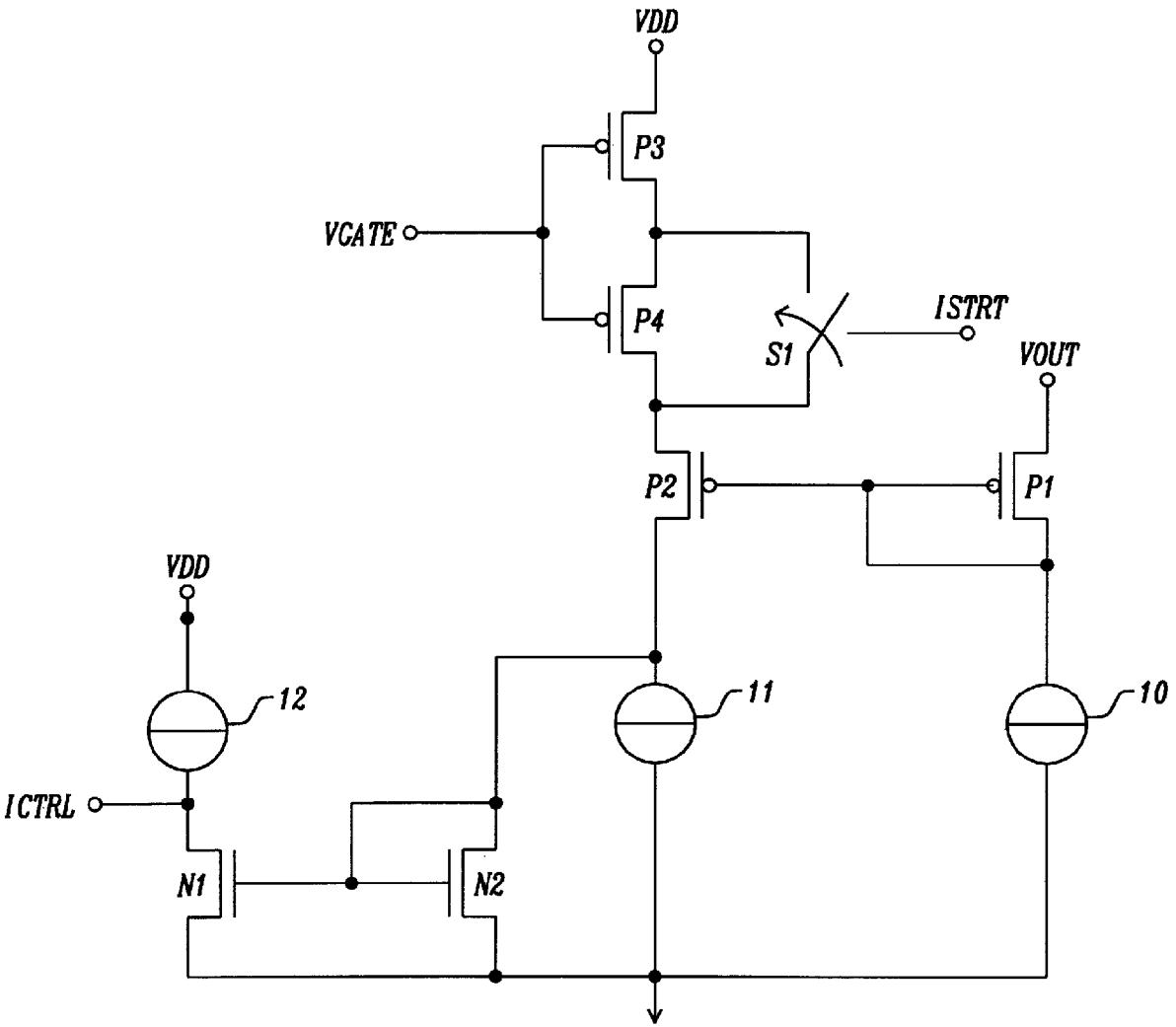
FIG. 10 is a circuit schematic diagram illustrating a low dropout (LDO) regulator for modifying the sensed current at startup with a series cascode p-channel pull-up in accordance with a third embodiment of the disclosure.

FIG. 10 is a circuit schematic diagram illustrating a low dropout (LDO) regulator for modifying the sensed current at startup with a series cascode p-channel pull-up in accordance with a third embodiment of the disclosure. The circuit contains a current source 12 between the VDD signal and control signal ICTRL. A current mirror network is formed with n-channel MOSFET N1, and n-channel MOSFET N2. Current control 11 is coupled to the n-channel current mirror network formed with n-channel MOSFET N1, and n-channel MOSFET N2. A second current mirror network is formed with p-channel MOSFET P1, and p-channel MOSFET P2. The second current mirror network is coupled to output voltage VOUT, and current source 10. A switch S1 is placed in series with p-channel MOSFET P3. P-channel MOSFET P3 is in series with a p-channel MOSFET P4. The gate voltage, VGATE, is connected to both the gate connection to p-channel MOSFET P3, and p-channel MOSFET P4. The sensed current is increased in startup to reduce the current limit. At startup, switch S1 is closed and p-channel MOSFET P4 is shorted. Once current ISTRT is asserted, switch S1 is opened, and the normal current limit is restored.

Figure 11:
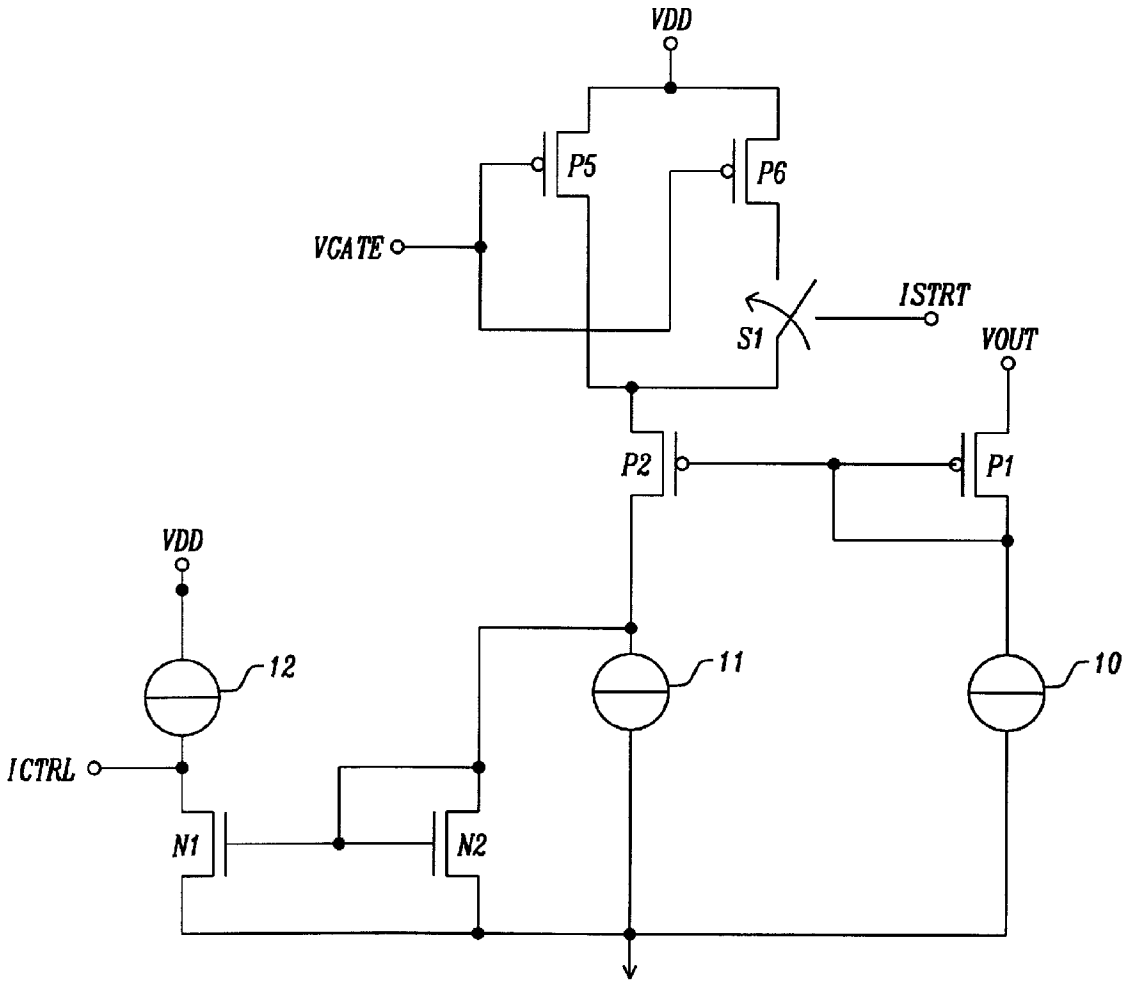
FIG. 11 is a circuit schematic diagram illustrating a low dropout (LDO) regulator for modifying the sensed current at startup with parallel p-channel pull-up in accordance with a fourth embodiment of the disclosure.

FIG. 11 is a circuit schematic diagram illustrating a low dropout (LDO) regulator for modifying the sensed current at startup with parallel p-channel pull-up in accordance with a fourth embodiment of the disclosure. The circuit contains a current source 12 between the VDD signal and control signal ICTRL. A current mirror network is formed with n-channel MOSFET N1, and n-channel MOSFET N2. Current control 11 is coupled to the n-channel current mirror network formed with n-channel MOSFET N1, and n-channel MOSFET N2. A second current mirror network is formed with p-channel MOSFET P1, and p-channel MOSFET P2. The second current mirror network is coupled to output voltage VOUT, and current source 10. A switch S1 is placed in series with p-channel MOSFET P6. P-channel MOSFET P5 is in parallel with a p-channel MOSFET P6. The gate voltage, VGATE, is connected to both the gate connection to p-channel MOSFET P5 AND p-channel MOSFET P6. The sensed current is increased in startup to reduce the current limit. At startup, switch S1 is closed and p-channel MOSFET P6 is in parallel with p-channel MOSFET P5, increasing the sensed current. Once current ISTRT is asserted, switch S1 is opened, and the normal current limit is restored.

Figure 12:
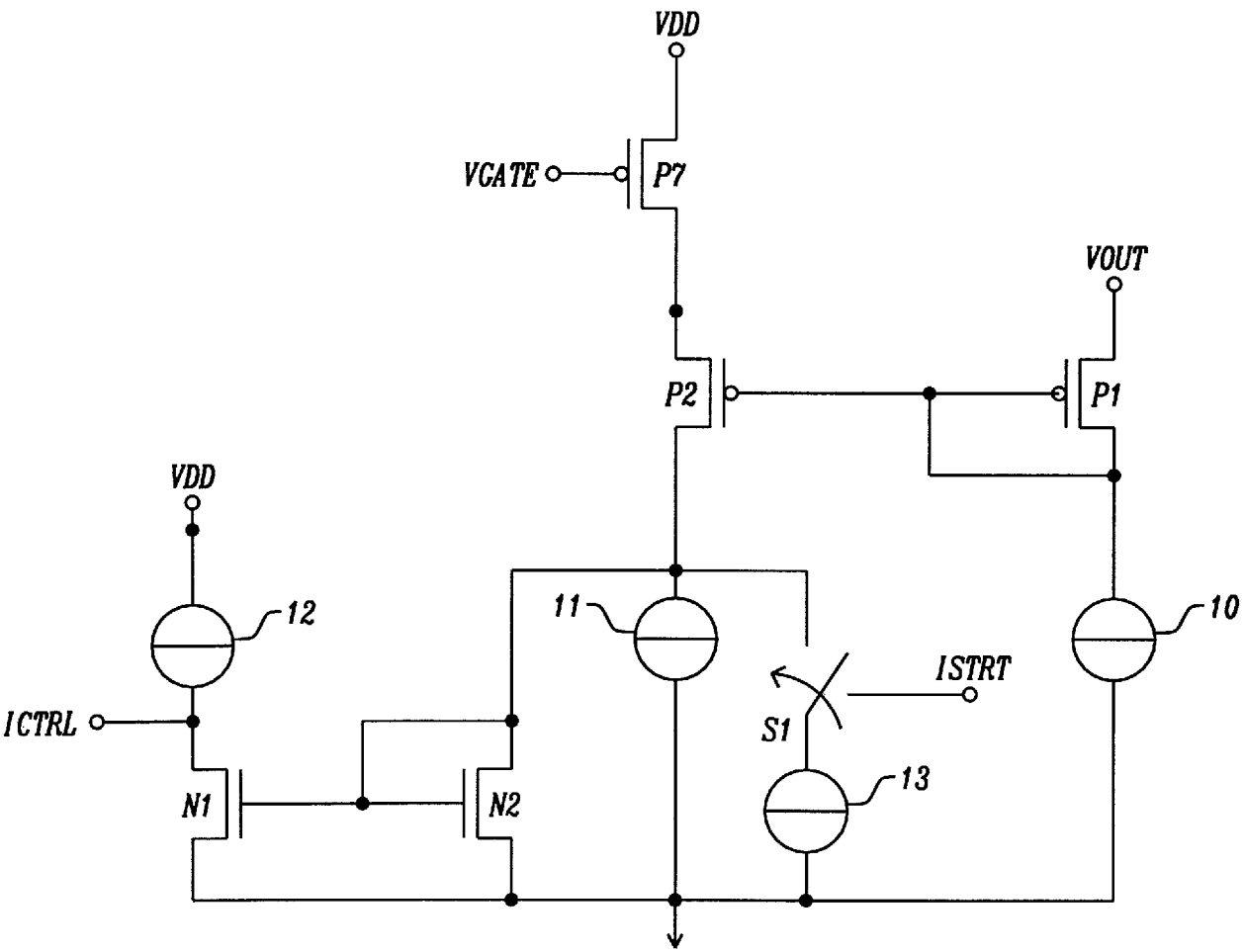
FIG. 12 is a circuit schematic diagram illustrating a low dropout (LDO) regulator for modifying the sensed current at startup with single p-channel pull-up in accordance with a fifth embodiment of the disclosure.

FIG. 12 is a circuit schematic diagram illustrating a low dropout (LDO) regulator for modifying the sensed current at startup with single p-channel pull-up in accordance with a fifth embodiment of the disclosure. The circuit contains a current source 12 between the VDD signal and control signal ICTRL. A current mirror network is formed with n-channel MOSFET N1, and n-channel MOSFET N2. Current control 11 is coupled to the n-channel current mirror network formed with n-channel MOSFET N1, and n-channel MOSFET N2. A second current mirror network is formed with p-channel MOSFET P1, and p-channel MOSFET P2. The second current mirror network is coupled to output voltage VOUT, and current source 10. A switch S1 is placed in series with current source 13. P-channel MOSFET P7 is in series with a p-channel MOSFET P2. The gate voltage, VGATE, is connected to the gate connection to p-channel MOSFET P7. At startup, the reference current is decreased to reduce the current limit. At startup, switch S1 is open to disconnect current source 13; this reduces the reference current. Once current ISTRT is asserted, switch S1 is closed, and the normal current limit is restored.

Figure 13:
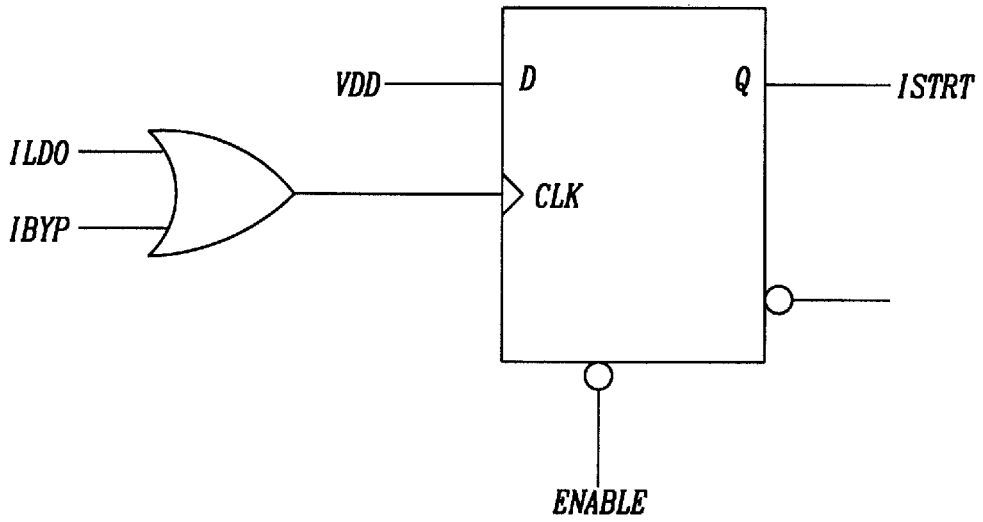
FIG. 13 is a circuit schematic diagram illustrating the ILDO/IBYP control select circuit in accordance with the embodiment of this disclosure.

FIG. 13 is a circuit schematic diagram illustrating the ILDO/IBYP control select circuit in accordance with the embodiment of this disclosure. In FIG. 13, a DQ flip-flop is shown connected to signals and a logic gate. The power supply voltage VDD, is coupled to input D of the DQ flip-flop network. The signal ISTRT is coupled to the input Q of the DQ flip-flop network. A logic OR gate has input ILDO and IBYP and whose signal output is connected to the clock CLK of the DQ flip-flop network. When the LDO is not enabled, signal ISTRT is cleared. The state of the DQ flip-flop is maintained until the clock signal is received. The output of comparators 5 and 6 of FIG. 5 are logically OR'ed to generate the clock signal. In this allows for the reduced current limit to be applied only once. Given that the low dropout (LDO) regulator was initiated in the regulation mode, the signal ILDO will serve as a clock signal to change the state of the ISTRT signal from logic low to logic high state. Given that the LDO transitions into a bypass mode, IBYP signal will be asserted without change of the ISTRT signal state.

Figure 14:
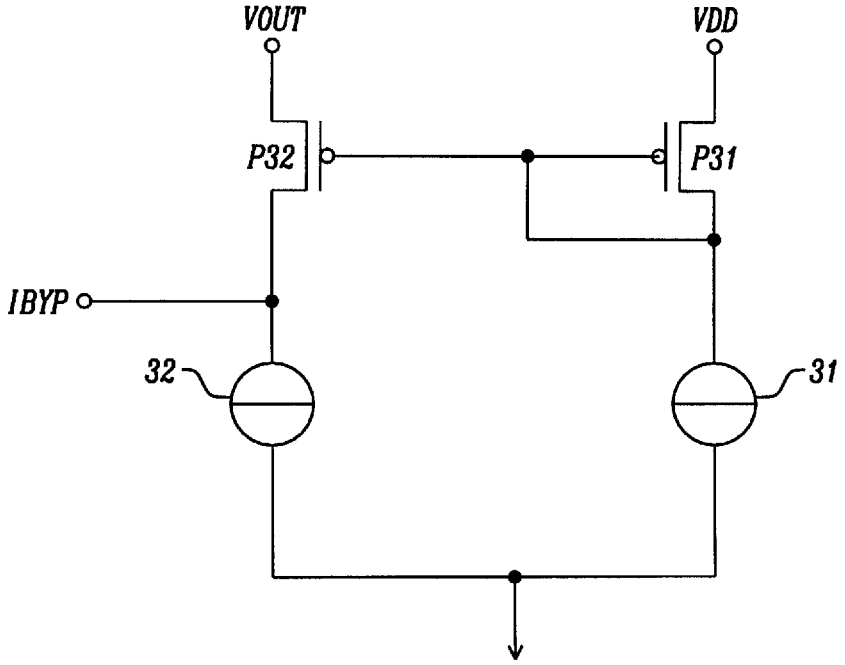
FIG. 14 is a circuit schematic diagram illustrating the VOUT/VDD comparator control circuit in accordance with the embodiment of this disclosure.

FIG. 14 is a circuit schematic diagram illustrating the VOUT/VDD comparator control circuit in accordance with the embodiment of this disclosure. The circuit contains a p-channel MOSFET-based current mirror network, with a first p-channel MOSFET 31 and a second p-channel MOSFET 32. The source of p-channel MOSFET 31 is connected to power supply VDD, and the source of p-channel MOSFET 32 is connected to VOUT. Current sources 31 and 32 are coupled to p-channel MOSFET 31 drain and p-channel MOSFET 32 drain, respectively. The signal IBYP is connected to the drain of p-channel MOSFET 32, and current source 32. The inputs to the VDD/VOUT comparator compares the VOUT signal with the VDD signal. Given that current source 32 is small compared to current source 31, an offset is generated to initiate the comparator. This can also be achieved by changing the relative size of the p-channel MOSFETs in the current mirror, where p-channel MOSFET 31 is made smaller than p-channel MOSFET 32.

Figure 15:
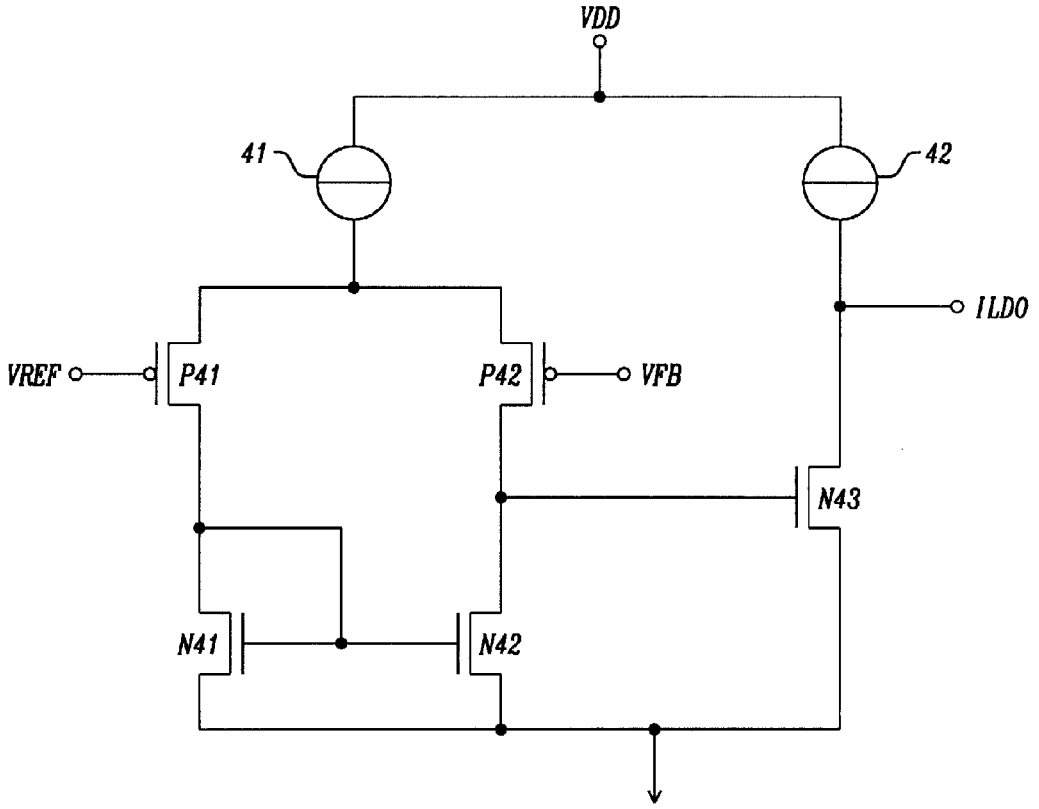
FIG. 15 is a circuit schematic diagram illustrating the VREFNFB comparator control circuit in accordance with the embodiment of this disclosure.

FIG. 15 is a circuit schematic diagram illustrating the VREF/VFB comparator control circuit in accordance with the embodiment of this disclosure. An n-channel MOSFET current mirror network is formed from n-channel MOSFET N41 and n-channel MOSFET N42. The n-channel MOSFET current mirror N42 drain is connected to the gate of an additional n-channel MOSFET N43. A differential pair signal of the comparator utilizes a first p-channel MOSFET P41 and a second p-channel MOSFET P42 which receive signals VREF, and VFB, respectively. The comparator differential pair input signals are in parallel with the n-channel MOSFET current mirror network formed from n-channel MOSFETs N41 and N42, respectively. Current source 41 and 42 are connected to the power supply source voltage, VDD. The output signal of the comparator network is signal ILDO which is coupled between the current source 42, and n-channel MOSFET 43. The differential offset can be formed by having p-channel MOSFET 41 have a larger width than p-channel MOSFET 42. At startup, the signal VFB is lower than the signal VREF and the output signal ILDO is lowered to ground. As the output voltage increases, the voltage signal VFB approaches the voltage level of signal VREF; as they approach the same voltage magnitude, the signal ILDO is raised to the VDD voltage. The current mirror network can be constructed from p-channel MOSFET devices, or n-channel MOSFET devices. Current mirror networks can also be bipolar junction transistors (BJTs), homo-junction BJT devices, and hetero-junction bipolar transistors (HBTs). In addition, the comparator differential pair can be constructed of MOSFET devices, BJT, or HBT devices. In addition, current sources can also be constructed from MOSFETs, or bipolar transistors.

Figure 16:
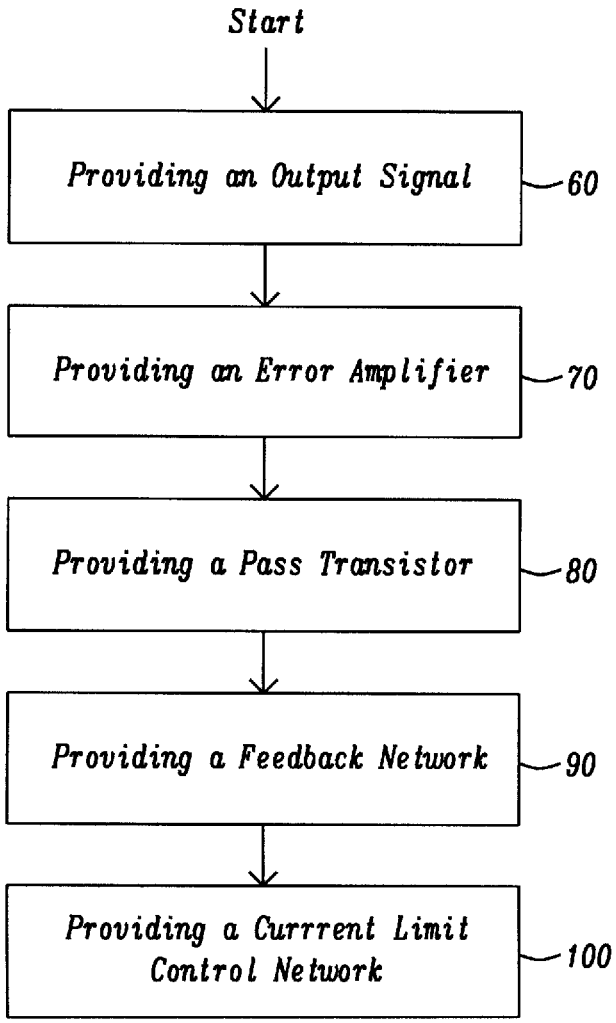
FIG. 16 is a method of limiting startup inrush current in a low dropout circuit in accordance with the embodiment of this disclosure.

FIG. 16 is a method of limiting startup inrush current in a low dropout circuit in accordance with the embodiment of this disclosure. A method of limiting startup inrush current in a low dropout circuit comprising of the steps of low dropout circuit providing an output voltage 60, providing an error amplifier 70, providing a pass transistor 80, providing a feedback network electrically connected to said pass transistor and whose output is electrically coupled to the input of said error amplifier 90, and providing a current limit control network whose input is electrically connected to said pass transistor and the electrical output of said error amplifier and whose output is providing a current limit 100.

The method of limiting startup inrush current in a low dropout circuit further comprising of the following steps of providing a LDO mode current control limit comparator, comparing a feedback voltage and a reference voltage, and providing a signal to the ILDO/IBYP logic network.

The method of limiting startup inrush current in a low dropout circuit further comprising of the following steps of providing a Bypass mode current control limit comparator, comparing a power supply voltage and output voltage; and providing a signal to the ILDO/IBYP logic network.

The method of limiting startup inrush current in a low dropout circuit further comprising providing a LDO mode current control limit comparator, providing a Bypass mode current control limit comparator, comparing a feedback voltage and a reference voltage in said LDO mode current control limit comparator, comparing a power supply voltage and output voltage in said Bypass mode current control limit comparator, providing a signal to the ILDO/IBYP logic network, and providing a signal to a said current limit control loop from said ILDO/IBYP logic network.

As such, a novel low dropout (LDO) regulator with improved minimization and mitigation of startup inrush current in the LDO and Bypass modes of operation are herein described. The circuit provides a limitation of the startup inrush current. The improvement is achieved with minimal impact on silicon area or power usage. The improved low dropout (LDO) circuit reduces switching and transient power, and lowers the risk of overvoltage, and reliability issues. Other advantages will be recognized by those of ordinary skill in the art. The above detailed description of the disclosure, and the examples described therein, has been presented for the purposes of illustration and description. While the principles of the disclosure have been described above in connection with a specific device, it is to be clearly understood that this description is made only by way of example and not as a limitation on the scope of the disclosure.

What is claimed is:

1. A low dropout device with limiting startup inrush current, the device comprising:

an error amplifier;

a pass transistor coupled to said error amplifier;

a feedback network electrically connected to said pass transistor wherein an output of said feedback network is electrically coupled to an input of said error amplifier;

a current limit control network whose current limit control network input is electrically connected to said pass transistor and an electrical output of said error amplifier and whose current limit control network output provides a current limit;

a Bypass mode current control limit comparator, wherein an input of said Bypass mode current control limit comparator comprises a supply voltage, and an output of said pass transistor;

a Low Dropout (LDO) mode current control limit comparator, wherein an input of said Low Dropout (LDO) mode current limit comparator comprises a reference voltage and the output of said feedback network; and a Low Dropout (LDO) mode/Bypass mode select network whose inputs are the output of said Low Dropout (LDO) mode current control limit comparator, and said Bypass mode current control limit comparator, and whose Low Dropout (LDO) mode/Bypass mode select network output is coupled to said current limit control network to reduce the current limit at startup of the low dropout device.

2. The low dropout device of claim 1, wherein said current limit control network comprises:

a current control signal input;

a current startup signal input;

a first current source between a power source and said current control signal input;

a second current source between a ground source and said current control signal input;

a switch whose input is said current startup signal input, wherein the current startup signal input is the output of said Low Dropout (LDO) mode/Bypass mode select network.

3. The low dropout device of claim 2, further comprising a third current source in series with said switch between said power source and said current control signal input.

4. The low dropout device of claim 2, further comprising a third current source in series with said switch between said ground source and said current control signal input.

5. The low dropout device of claim 2, wherein said second current source is an n-channel MOSFET current mirror network, and further comprising:

a third current source in series with said switch between said power source and said current control signal input; and a p-channel MOSFET current mirror network.

6. The low dropout device of claim 5, further comprising of at least one p-channel MOSFET connected to said power source.

7. The low dropout device of claim 6, wherein said p-channel MOSFETs are a plurality of p-channel MOSFETs in a series cascode configuration or in a parallel configuration in between said power source and said p-channel MOSFET current mirror.

8. The low dropout device of claim 6, wherein said at least one p-channel MOSFETs are in a parallel or in series configuration with said switch.

9. The low dropout device of claim 2, further comprising:

a DQ flip-flop network connected to said power source and a start function (ISTRT);

a Low Dropout (LDO) current signal (ILDO);

a Bypass mode current signal (IBYP);

a logic gate whose inputs are said Low Dropout (LDO) current signal (ILDO), and said Bypass mode current signal (IBYP) and whose output is connected to a clock input of a DQ flip-flop; andan ENABLE function connected to said DQ flip-flop.

10. The low dropout device of claim 1, wherein said Low Dropout (LDO) mode current control limit comparator input further comprises:

a power source (VDD);

a third current source connected to the power source (VDD);

a fourth current source connected to the power source (VDD);

a ground source;

a p-channel MOSFET differential pair connected to said-third current source;

a first reference input signal (VREF) connected to a p-channel MOSFET differential pair gate;

a second feedback input signal (VFB) connected to a second p-channel MOSFET differential pair gate;

an n-channel MOSFET current mirror connected to said p-channel MOSFET differential pair;

an output n-channel transistor coupled between said p-channel differential pair and said n-channel MOSFET current mirror; and an output Low Dropout (LDO) current signal (ILDO) connected to the drain of said output n-channel MOSFET.

11. The low dropout device of claim 1, wherein said Bypass mode current control limit comparator comprises:

a first power source signal (VDD);

a second signal (VOUT);

a ground source;

an output signal Bypass mode current control signal (IBYP);

a p-channel MOSFET current mirror electrically coupled to said first power source signal (VDD) and said second signal (VOUT);

a first current control electrically coupled between the bypass mode current signal (IBYP) and said ground source;

a second current control electrically coupled between said p-channel MOSFET current mirror and said ground source.

12. A method of limiting startup inrush current in a low dropout circuit comprising of the following steps:

providing a power source;

providing an output signal;

providing an error amplifier;

providing a pass transistor between said power source and said output signal wherein said pass transistor is coupled to said error amplifier and supplied from the power source;

providing a feedback network electrically connected to said pass transistor and whose output is electrically coupled to an input of said error amplifier;

providing a current limit control network whose input is electrically connected to said pass transistor and an electrical output of said error amplifier and whose output provides a current limit;

providing a Bypass mode current control limit comparator, wherein an input of said Bypass mode current control limit comparator comprises a supply voltage, and an output of said pass transistor;

a Low Dropout (LDO) mode current control limit comparator, wherein an input of said Low Dropout (LDO) mode current limit comparator comprises a reference voltage and the output of said feedback network; and a Low Dropout (LDO) mode/Bypass mode select network whose inputs are the outputs of said Low Dropout (LDO) mode current control limit comparator, and said Bypass mode current control limit comparator, and whose Low Dropout (LDO) mode/Bypass mode select network output is coupled to said current limit control network to reduce the current limit at startup of the low dropout device.

13. The method of limiting startup inrush current in the low dropout circuit of claim 12, further comprising of the following steps:

comparing a feedback voltage and a reference voltage; and providing a signal to the Low Dropout (LDO) mode/Bypass mode select network.

14. The method of limiting startup inrush current in the low dropout circuit of claim 13, further comprising of the following step: coupling said Low Dropout (LDO) mode/Bypass mode select network to said current limit control network.

15. The method of limiting startup inrush current in the low dropout circuit of claim 12, further comprising of the following steps:

comparing the supply voltage and an output voltage corresponding to the output signal; and providing a signal (IBYP) to the Low Dropout (LDO) mode/Bypass mode select network.

16. The method of limiting startup inrush current in the low dropout circuit of claim 15, further comprising of the following step:

coupling said Low Dropout (LDO) mode/Bypass mode select network to said current limit control network.

17. The method of limiting startup inrush current in the low dropout circuit of claim 12, further comprising:

comparing a feedback voltage and the reference voltage in said Low Dropout (LDO) mode current control limit comparator;

comparing the supply voltage and an output voltage corresponding to the output signal in said Bypass mode current control limit comparator;

providing a signal (IBYP) the Low Dropout (LDO) mode/Bypass mode select network; and providing a signal to a said current limit control network from said Low Dropout (LDO) mode/Bypass mode select network.

18. The method of limiting startup inrush current in the low dropout circuit of claim 17, further comprising of the following step:

coupling said Low Dropout (LDO) mode/Bypass mode select network to said current limit control network.

* * * * *